US007703461B2

(12) United States Patent
Furuya et al.

(10) Patent No.: US 7,703,461 B2
(45) Date of Patent: Apr. 27, 2010

(54) ROTARY RINSER

(75) Inventors: Yukihito Furuya, Yamanashi (JP); Isao Oi, Ishikawa (JP)

(73) Assignee: Suntory Holdings Limited, Osaka (JP)

( * ) Notice: Subject to any disclaimer, the term of this patent is extended or adjusted under 35 U.S.C. 154(b) by 1012 days.

(21) Appl. No.: 10/562,993

(22) PCT Filed: Jun. 29, 2004

(86) PCT No.: PCT/JP2004/009519

§ 371 (c)(1),
(2), (4) Date: May 15, 2006

(87) PCT Pub. No.: WO2005/000488

PCT Pub. Date: Jan. 6, 2005

(65) Prior Publication Data

US 2006/0278259 A1 Dec. 14, 2006

(30) Foreign Application Priority Data

Jun. 30, 2003 (JP) ..... 2003-188630

(51) Int. Cl.
*B08B 3/00* (2006.01)

(52) U.S. Cl. ..... 134/95.1; 134/178; 137/580

(58) Field of Classification Search ..... 137/580; 134/95.1, 178

See application file for complete search history.

(56) References Cited

U.S. PATENT DOCUMENTS 4,405,162 A * 9/1983 Williams ..... 285/95
4,647,077 A * 3/1987 Ethridge et al. ..... 285/98
4,877,054 A * 10/1989 Walter ..... 137/560
5,478,475 A * 12/1995 Morita et al. ..... 210/676
5,707,186 A * 1/1998 Gobell et al. ..... 409/136

FOREIGN PATENT DOCUMENTS

JP 11-179314 A2 7/1999
JP 2001-246342 A2 9/2001
JP 2001-340824 A2 12/2001

OTHER PUBLICATIONS

International Search Report dated Oct. 5, 2004 (2 pages).

* cited by examiner

*Primary Examiner*—Michael Barr
*Assistant Examiner*—Jason Heckert
(74) *Attorney, Agent, or Firm*—Flynn, Thiel, Boutell & Tanis, P.C.

(57) ABSTRACT

A rotary rinser 1 which injects dual fluids includes a rotary valve 11 in which an admixture of one of the fluids into the other fluid is prevented.

A stationary valve member 28 is formed with a chemical liquid supply passage 60 and an air supply passage 48 while a rotary valve member 16 is formed with a chemical liquid discharge passage 18 and an air discharge passage 24. As the rotary valve member 16 rotates, a supply passage and a discharge passage for each fluid move into and out of communication. Sliding surfaces into which the chemical liquid passages 60 and 22*a* open (sliding surfaces of a chemical liquid stator 34 and a chemical liquid distributor 22) and sliding surfaces through which the air passage 48 and 24 move into and out of communication (sliding surfaces of the rotary valve member 16 and the air distributor 49) are disposed at different radial positions and at different elevations.

11 Claims, 5 Drawing Sheets

ROTARY RINSER

TECHNICAL FIELD

The present invention relates to a rotary rinser, in particular, to a rotary rinser including a rotary valve which supplies a cleansing fluid by allowing or interrupting a communication between a passage formed in a stationary member and a passage formed in a rotary member.

BACKGROUND ART

A conventional rotary rinser comprises a revolving body, bottle grippers disposed at an equal interval circumferentially around the outer periphery of the revolving body for receiving and inverting vessels as they are conveyed on a conveyor, a cleansing nozzle disposed on the revolving body at a location corresponding to each bottle gripper for injecting a cleansing fluid into a vessel which is held in its inverted position by the bottle gripper to cleanse the vessel, and a rotary valve which distributes an externally fed cleansing fluid to each cleansing nozzle (see, for example, Japanese Laid-Open Patent Application No. 11-277017).

A conventional rotary valve comprises a stationary valve member, and a rotary valve member which is disposed for rotation in sliding contact with the stationary valve member. The stationary valve member is formed with a supply passage which distributes the cleansing fluid fed from a pump while the rotary valve member is formed with a discharge passage which feeds the cleansing fluid into a piping connected to the cleansing nozzle. When the discharge passage of the rotary valve member communicates with the supply passage of the stationary passage at a given interval during the rotation of the rotary valve member, the cleansing fluid is fed through the piping into the cleansing nozzle to be injected into a vessel which is held gripped by one of the bottle grippers for cleansing this vessel.

When the rotary rinser constructed in the manner mentioned above is applied to an aseptic filling system which performs a filling of a sterilized liquid in an aseptic environment, the cleansing nozzle may be constructed as a double tube so that both the cleansing liquid and the air can be injected into the vessel. A cleansing nozzle having a double tube structure is used for purposes of substituting an aseptic air for the air within the vessel and for preventing an egress of the cleansing liquid from the vessel from being hindered by a narrowed opening of the vessel.

To feed the cleansing liquid and the air into the cleansing nozzle having the double tube structure as mentioned, the stationary valve member of the rotary valve is provided with supply passages for two kinds of fluids, the cleansing liquid and the air. The supply passages for such two kinds of fluids may be formed on a circumference of an equal radius as displaced from each other circumferentially or may be formed on circumferences having different radii. In either instance, sliding surfaces on the stationary valve member and on the rotary valve member into which the dual fluid supply passages open are located on a common plane.

In a conventional rotary valve which enables a dual fluid supply, distribution zones for dual fluids are located on a common plane and adjacent to each other, and this is likely to cause an interference between the fluids. In particular, when there exists a pressure difference between the dual fluids, a higher pressure fluid may permeate into a lower pressure fluid, and where a highly osmotic liquid such as sodium hydroxide is used, there exists a problem that it may be admixed with the other fluid. If sodium hydroxide finds its way into the air passage, there is a likelihood that it may be dried up in the air passage to be deposited on a wall surface as a scale to cause a nozzle plugging.

The present invention is made to overcome such problem, and has for its object the provision of a rotary rinser having a rotary valve which avoids the likelihood of fluids being brought into admixture if the rotary valve is used to distribute dual fluids.

DISCLOSURE OF THE INVENTION

A rotary rinser according to one embodiment of the present invention comprises a stationary member in which a fluid supply passage is formed, and a rotary member disposed rotatably in sliding contact with the stationary member and formed with a discharge passage which can communicate with the supply passage and the communication of which is interrupted as it rotates, an arrangement being such that when the discharge passage communicates with the supply passage of the stationary member during the rotation of the rotary member, a fluid is fed to a cleansing nozzle to be injected into a vessel, in which two sets of the supply passage and the discharge passage are provided, each set having a sliding surface into which the passages of the respective set open, the sliding surfaces of the sets being disposed at different elevations.

In the rotary rinser according to an embodiment of the present invention, a sliding surface into which the supply passage and the discharge passage for one fluid open is disposed at a different elevation from a sliding surface in which the supply passage and the discharge passage for the other fluid open, thus completely separating two kinds of fluids to avoid an admixture thereof. This is also true when three or more kinds of fluids are used.

A rotary rinser according to an embodiment of the present invention relates to a rotary rinser in which the sliding surfaces are radially offset from each other. In the rotary rinser according to the invention, a sliding surface into which the supply passage and the discharge passage for one fluid open and a sliding surface into which the supply passage and the discharged passage for the other fluid open are disposed at different elevations and are radially offset from each other, thus completely separating two kinds of fluids to avoid an admixture thereof. The same is true when three or more kinds of fluids are used.

A rotary rinser according to an embodiment of the invention features that the fluids are a cleansing liquid and a gas.

When one of two kinds of fluids is a liquid while the other is a gas, the liquid is likely to permeate into a gas passage. For example, when a chemical liquid is used as a cleansing liquid, if the components of the chemical liquid are dried up and solidified in the gas passage, there arises a likelihood that a nozzle plugging may occur. However, in the arrangement of the present invention, an ingress of the liquid into the gas passage can be prevented in a positive manner.

BEST MODES FOR CARRYING OUT THE INVENTION

Figure 2:
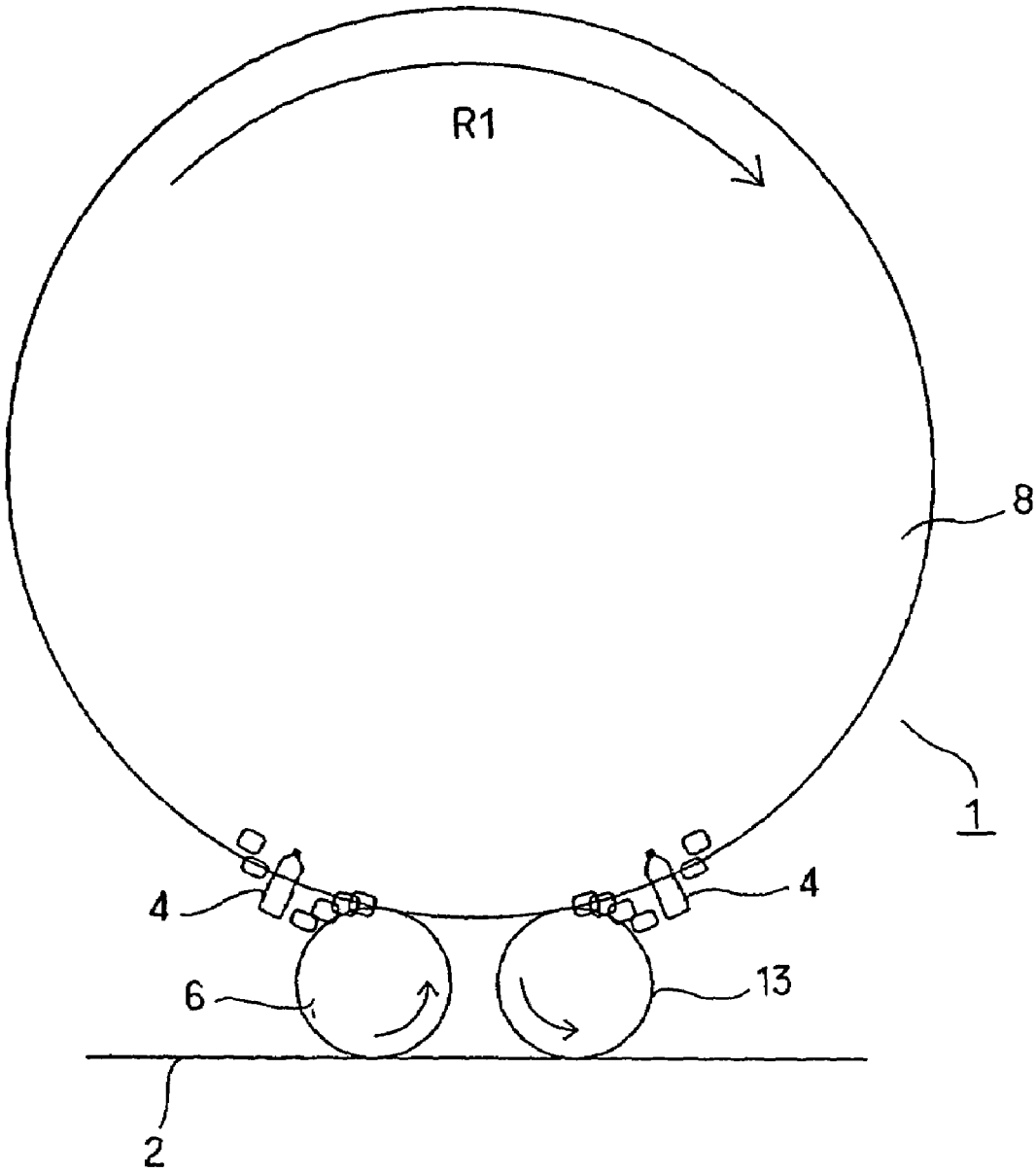
FIG. 2 is a plan view illustrating the overall layout of the rotary rinser in a simplified form.
Figure 3:
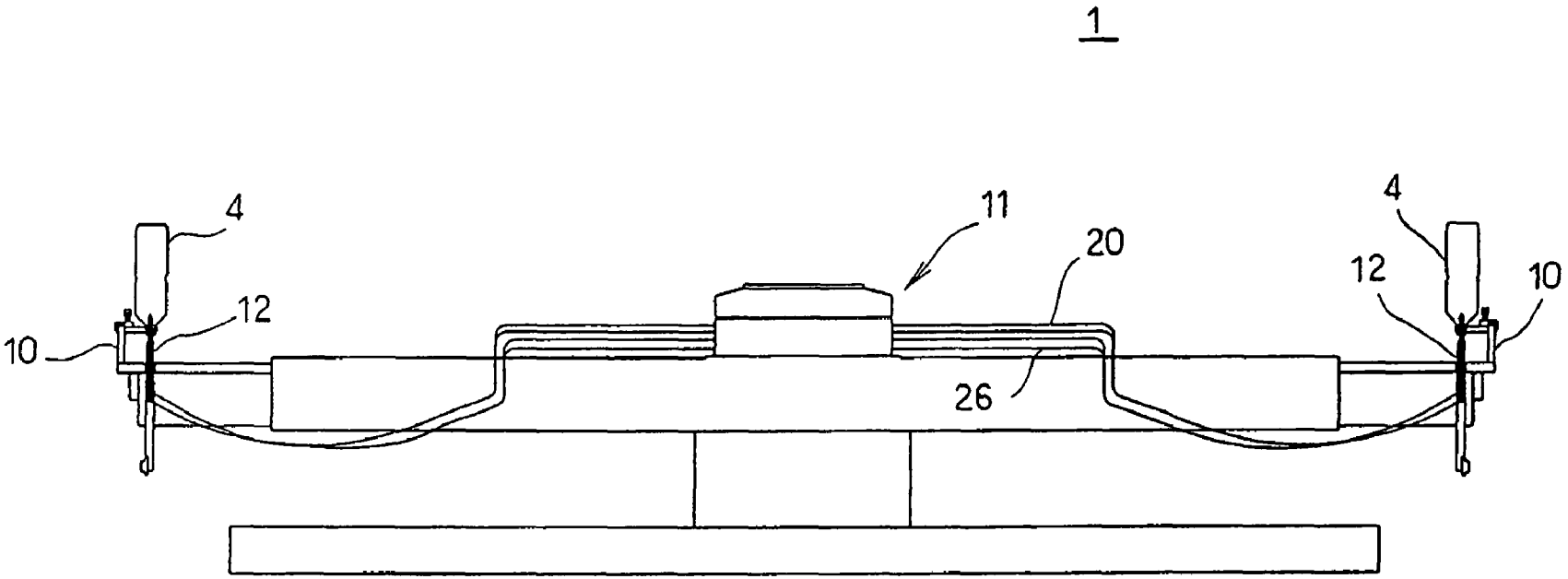
FIG. 3 is a longitudinal section schematically illustrating the arrangement of the rotary rinser.

Several embodiments of the present invention shown in the drawings will now be described. Vessels 4 are conveyed on a vessel conveyor 2 and are supplied to a rotary rinser, generally indicated by numeral 1, through an inlet star-wheel 6. Vessels 4 which are supplied are gripped each by one of bottle grippers 10 which are mounted around the outer periphery of a revolving body 8 of the rotary rinser 1 at an equal interval circumferentially. The bottle gripper 10 which has gripped one of the vessels 4 is inverted while rotating in a direction indicated by an arrow R1 shown in FIG. 2 to maintain the vessel 4 in its inverted position.

A cleansing chemical liquid which is sodium hydroxide in this embodiment and an aseptic air which are fed through a rotary valve, generally indicated by numeral 11, are injected by a cleansing nozzle 12 into the vessels 4 which are conveyed in their inverted positions while being gripped by the bottle grippers 10, whereby the vessels are cleansed. The cleansing nozzle 12 has a double tube structure nozzle which is known in the art, and is not shown, but it is to be noted that it includes a centrally disposed chemical liquid nozzle, which is surrounded by an aseptic air nozzle.

Vessels 4 which have been cleansed by the injection of the chemical liquid and the aseptic air from the cleansing nozzle 12 are inverted again by the bottle grippers 10 to their erect positions to be delivered onto the conveyor 2 through an outlet star-wheel 13 to be conveyed to the succeeding step.

The construction of the rotary valve 11 will now be described. A revolving body (main wheel) 8 is fixedly mounted on a center rotary shaft 14, and a rotary shaft (rotary valve member) 16 is connected to the upper surface of the revolving body for integral rotation therewith. At its bottom, the rotary shaft 16 includes a flange-like portion 16*a* which is enlarged toward the outer periphery, and the lower surface of the flange-like portion 16*a* is connected to the top surface of the main wheel 8.

An annular projection 16*b* which projects upwardly is formed around the outer periphery of the flange-like portion 16*a*, and the annular projection 16*b* is internally formed with a discharge passage 18 for a cleansing chemical liquid (sodium hydroxide). The discharge passage 18 for the cleansing chemical liquid has chemical liquid introduction ports 18*a* which are formed in the top surface of the annular projection 16*b* at an equal interval circumferentially and chemical liquid discharge ports 18*b* which are formed in the outer peripheral surface of the annular projection 16*b*. In this manner, a cleansing chemical liquid supplied from a stationary valve member which will be described later is fed to each of the cleansing nozzle 12 through a chemical liquid piping 20 which is connected to each chemical liquid discharge port 18*b*.

A chemical liquid distributor 22 in the form of a thin annular disk is connected to the upper surface of the annular projection 16*b* which is formed around the outer periphery of the rotary shaft 16. The chemical liquid distributor 22 is formed with communication holes 22*a* which vertically extend therethrough and which are located in alignment with the introduction ports 18*a* of the chemical liquid discharge passage 18 which are formed at an equal interval in the upper surface of the annular projection 16*b*.

The rotary shaft 16 is internally formed with discharge passages 24 for the aseptic air which are located at an equal interval circumferentially, and the air discharge passage 24 has an air introduction port 24*a* which opens into the lateral surface of the rotary shaft 16 at a location adjacent to an upper shoulder thereof and an air discharge port 24*b* which opens into the outer peripheral surface of the flange-like portion 16*a*. The air discharge passage 24 is also connected to the cleansing nozzle 18 through a piping 26 in the similar manner as in the chemical liquid discharge passage 18 to feed the aseptic air into the outer peripheral side of the cleansing nozzle 12 which has a double tube construction. It is to be understood that the chemical liquid is fed to the inner periphery side of the cleansing nozzle 12 having the double tube structure to be injected into the vessel 4.

A stationary valve member 28 is disposed above the rotary shaft 16 which represents a rotary valve member. The stationary valve member 28 comprises a top plate 30 which forms an air stator, a sleeve member 32 which surrounds the outer periphery of the rotary shaft 16, and a chemical liquid stator 34 in the form of an annular member which is fitted around the outer periphery of the sleeve member 32 so as to be slidable up and down. At its top end, the rotary shaft 16 is formed with a portion 16*c* of a reduced diameter, which slidably extends through a circular opening 30*a* formed in the top plate 30 to be rotatably supported therein by a ball bearing 36 while a portion 16*d* of an increased diameter which is located below the portion 16*c* is disposed in sliding contact with the inner peripheral surface of the sleeve member 32 to be rotatably supported by a ball bearing 38. Seal members 40 and 42 are mounted between the portion 16*c* of a reduced diameter of the rotary shaft 16 and the top plate 30 of the stationary valve member 28 and between the portion 16*d* of an increased diameter of the rotary shaft 16 and the sleeve member 32 of the stationary valve member 28, respectively. The chemical liquid stator 34 which is elevatably fitted around the outer periphery of the sleeve member 32 is connected to the top plate 30 by a lock pin 43 which constrains a rotation thereof.

A space 44 is formed between the shoulder of the rotary shaft 16 and the inner surface of the top plate 30 which forms the air stator, and is sealed by the seal 40 which is mounted in the circular opening 30*a* in the top plate 30 and a seal 46 disposed in contact with the outer periphery of the portion 16*d* of an increased diameter of the rotary shaft 16. The top plate (air stator) 30 is formed with an air supply passage 48, and an aseptic air is supplied into the space 44 from a source of air supply, not shown.

Figure 1:
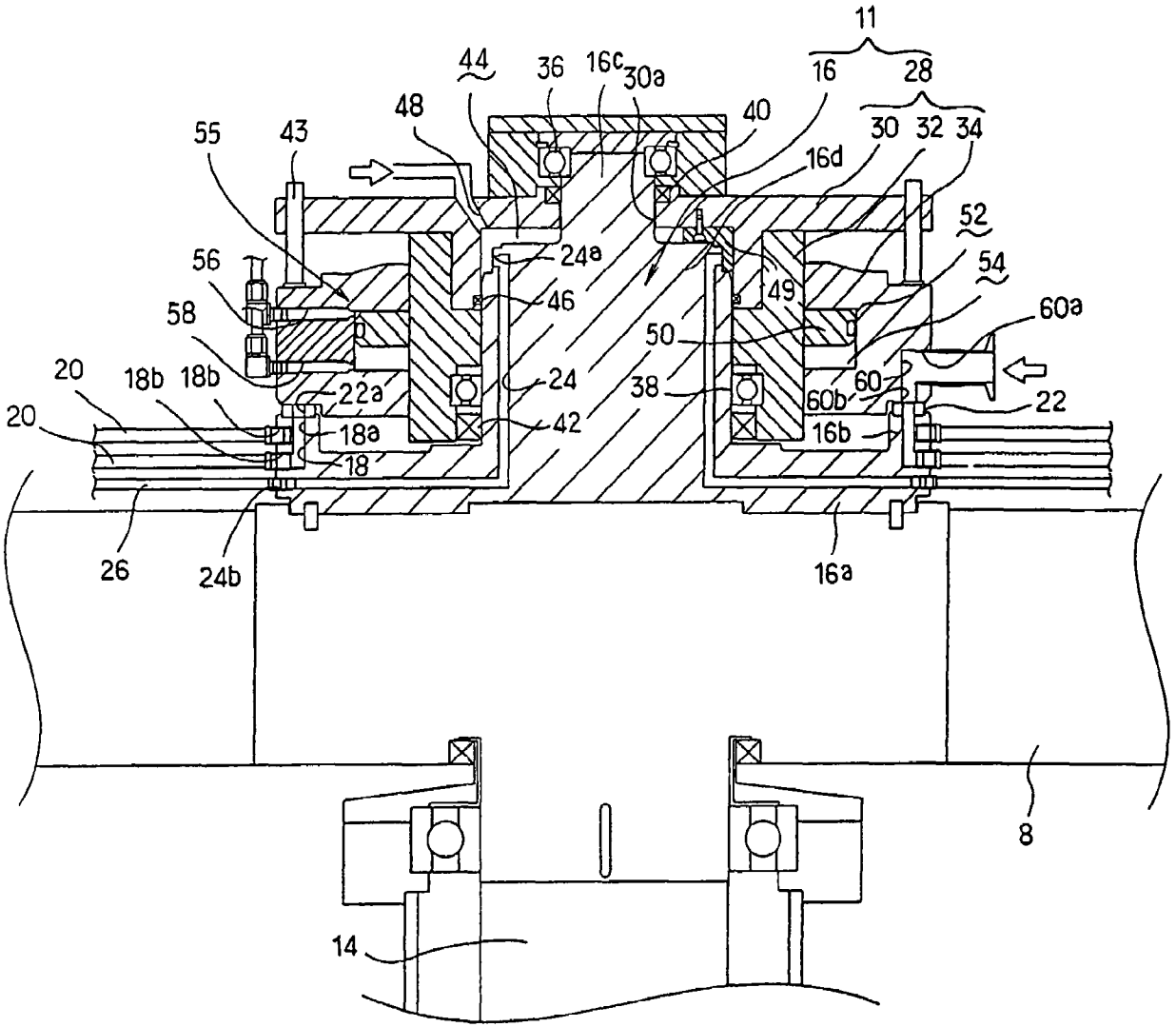
FIG. 1 is a longitudinal section a part of a rotary rinser according to one embodiment of the present invention.
Figure 4:
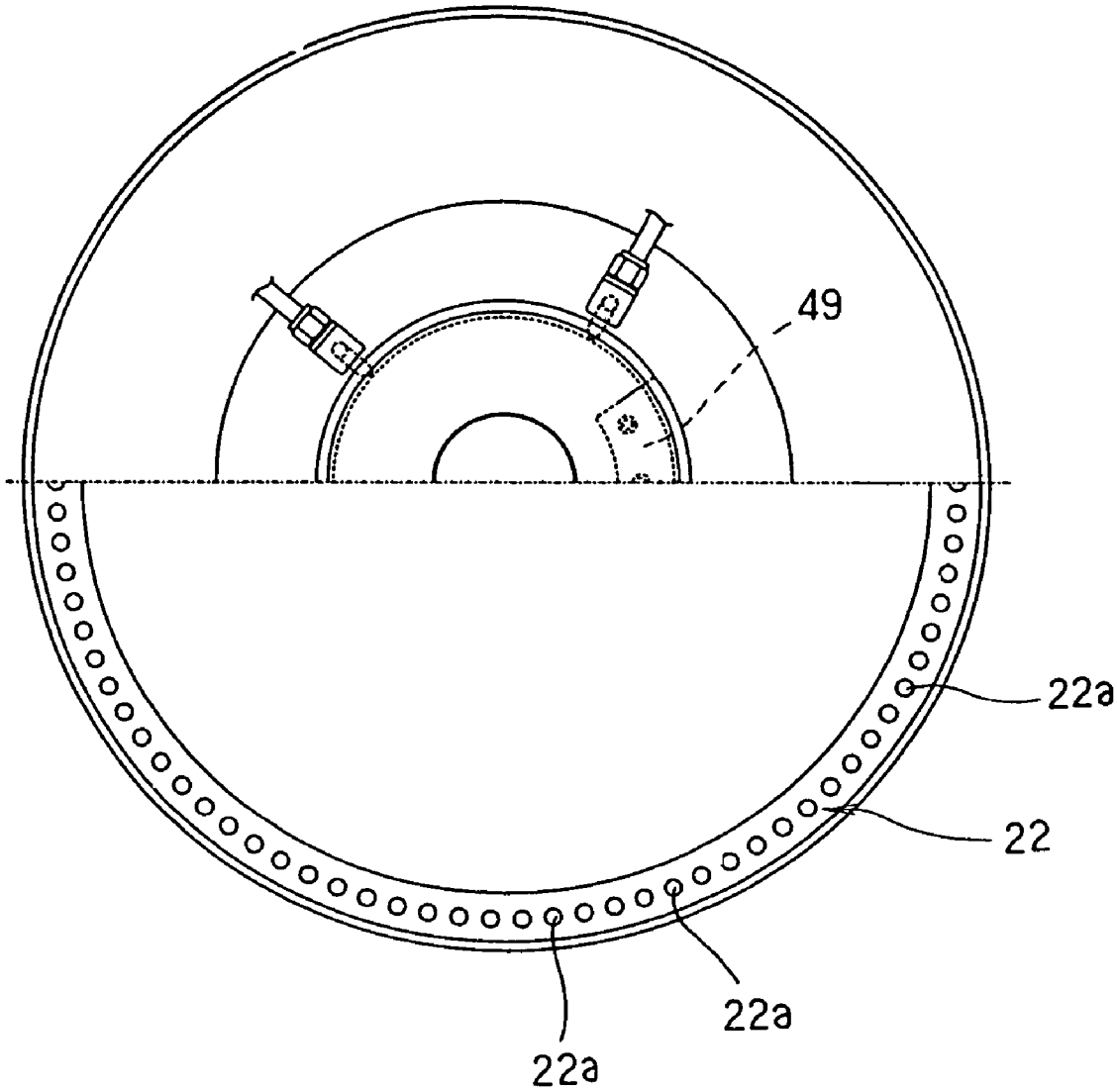
FIG. 4 is a cross section illustrating a chemical liquid distributor and an air distributor, upper and lower halves indicating different sections.

An air distributor 49 (see FIGS. 1 and 4) is secured to the inner surface of the top plate (air stator) 30 in a zone between the inlet star-wheel 6 and the outlet star wheel 13. The introduction port 24*a* of the air discharge passage 24 which opens into the shoulder of the rotary shaft 16 is sealed by the distributor 49 in this zone where the air distributor 49 is mounted, thus interrupting the supply of the air to the cleansing nozzle 12.

The chemical liquid stator 34 is elevatably fitted around the outer periphery of the sleeve member 32 of the stationary valve member 28. The chemical liquid stator 34 is channel-shaped in section, defining an annular space internally. On the other hand, a piston 50 is fixedly mounted on the outer surface of the sleeve member 32, and partitions the annular space within the chemical liquid stator 34 into upper and lower pressure chambers 52 and 54. The combination of the chemical liquid stator 34 which has the pressure chambers 52 and 54 and the piston 50 secured to the sleeve member 32 defines a cylinder unit 55 which elevates the chemical liquid stator 34. Air can be fed to or displaced from the upper and the lower pressure chamber 52 and 54 through air passages 56 and 58, respectively. When the air is fed to the lower pressure chamber 54, the chemical liquid stator 34 is forced down to be pressed against the chemical liquid distributor 22 while when the air is introduced into the upper pressure chamber 52, the chemical liquid stator 34 is lifted to be spaced from the distributor 22.

The chemical liquid stator 34 is formed with a chemical liquid supply passage 60, which has a chemical liquid supply port 60*a* which opens into the outer peripheral surface of the chemical liquid stator 34 and an arcuate elongate opening 60*b* which opens into the lower surface thereof. The arcuate elongate opening 60*b* is located on the circumference of the same radius as the chemical liquid distributor 22 and the introduction port 18*a* of the discharge port 18 formed in the rotary shaft 16, whereby when each communication hole 22*a* (see FIG. 4) of the rotating chemical liquid distributor 22 communicates with the elongate opening 60*b*, the chemical liquid is fed to the cleansing nozzle 12 to be injected into the vessel 4.

The operation of the rotary rinser 1 constructed in the manner mentioned above will now be described. Vessels 4 which are conveyed by the vessel conveyor 2 are supplied to the rotary rinser 1 through the inlet star-wheel 6, and are gripped one each by the bottle grippers 10. The bottle gripper 10 is inverted to bring the vessel 4 into its inverted position to place the mouth of the vessel 4 to be opposing to the cleansing nozzle 12 which is disposed therebelow while it is rotatively conveyed.

In the stationary valve member 28 of the rotary valve 11, the cylinder unit 55 is formed by the chemical liquid stator 34 having an annular space internally and the piston 50 secured to the outer surface of the sleeve member 32. During a normal cleansing operation of the rotary rinser 1, the air is introduced into the lower pressure chamber 54 to force the chemical liquid stator 34 down to be disposed into abutment against the chemical liquid distributor 22 which is connected to the upper surface of the annular projection 16*a* of the rotary shaft (rotary valve member) 16.

Under this condition, the rotary shaft 14 causes the revolving body (main wheel) 8 and the rotary shaft 16 to rotate while supplying a chemical liquid such as sodium hydroxide to the chemical liquid supply passage 60 of the chemical liquid stator 34 from a tank of chemical liquid, not shown, and also supplying the aseptic air to the air supply passage 48 of the air stator (top plate) 30 from a source of air supply.

The arcuate elongate opening 60*b* opens into the sliding surface of the chemical liquid stator 34 which slides with respect to the chemical liquid distributor 22 disposed therebelow, whereby the chemical liquid is normally supplied to the elongate opening 60*b* during the operation. On the other hand, the chemical liquid distributor 22 connected to the rotary shaft 16 is formed with the communication holes 22*a* at an equal interval circumferentially, which communicate with the introduction ports 18*a* of the chemical liquid discharge passage 18 formed in the rotary shaft 16. When the communication hole 22*a* of the chemical liquid distributor 22 which rotates together with the rotary shaft 16 is connected to the elongate opening 60*b* in the chemical liquid stator 34 as it rotates, the cleansing chemical liquid is fed through the elongate opening 60*b* of the chemical liquid supply passage 60 in the stator 34, the communication hole 22*a* in the chemical liquid distributor 22, the introduction port 18*a* of the chemical liquid discharge passage 18 in the rotary shaft 16, the discharge passage 18 and the chemical liquid piping 20 into the cleansing nozzle 12 to be injected into the vessel 4 which then assumes an inverted position.

It will be noted that the aseptic air is supplied into the space 44 defined between the outer surface of the shoulder of the rotary shaft 16 and the inner surface of the top plate 30 from the air supply passage 48 defined in the air stator (top plate) 30 of the stationary valve member 28. The air discharge passage 24 which is formed within the rotary shaft 16 has its introduction port 24*a* opening into the outer surface of the shoulder to be in communication with the space 44.

The air distributor 49 is secured to the inner surface of the top plate 30 only in a zone disposed between the outlet star-wheel 13 and the inlet star-wheel 6, and accordingly, when the discharge passage 24 which rotates as the rotary shaft 16 rotates passes through the zone for the distributor 49, the introduction port 24*a* is closed, thus interrupting the air supply to the cleansing nozzle 12. However, the air which is supplied from the air supply passage 48 into the space 44 is introduced into remaining air discharge passages 24 which are not interrupted by the air distributor 49, to be fed through the air piping 26 into the cleansing nozzle 12 to be blown into the vessel 4.

In the present embodiment, the zone in which the chemical liquid discharge passage 24 formed in the rotary shaft 16 is connected to the elongate opening 60*b* in the chemical liquid stator 34 coincides with the zone in which the air discharge passage 24 is connected to the space 44 or the zone which is free from the interruption by the air distributor 49 so as to allow the chemical liquid and the aseptic air to be simultaneously injected into the vessel 4. However, the invention is not limited to a construction which performs a simultaneous injection of the chemical liquid and the aseptic air, but the injection of the chemical liquid and the injection of the aseptic air may take place in different zones. In addition, the fluids which are injected are not limited to a chemical liquid and an aseptic air. By way of example, a chemical liquid may be initially injected into the vessel 4, followed by the injection of the aseptic water, or a normal cleansing liquid and the aseptic air may be simultaneously injected. While one of the fluids represent the aseptic air in the described embodiment, this need not be limited to the air, which may be replaced by another gas such as a nitrogen gas or a carbonic acid gas.

In the present embodiment, the sliding surfaces between the stationary valve member 28 in which the air supply passage 48 is formed and the rotary valve member (rotary shaft) 16 in which the air discharge passage 24 is formed (the sliding surfaces between the air distributor 49 and the rotary shaft 16), and the sliding surfaces between the stationary valve member (chemical liquid stator) 34 in which the chemical liquid supply passage 60 is formed and the rotary shaft 16 in which the chemical liquid discharge passage 18 is formed (the sliding surfaces between the chemical liquid stator 34 and the chemical liquid distributor 22) are completely separated from each other. Specifically, they are located at different radial positions, and there is a difference in elevation between their locations. Accordingly, if there is a pressure difference between the dual fluids, there is no likelihood of a permeation from a higher pressure side to a lower pressure side. In addition, if a highly osmotic liquid such as sodium hydroxide is used, there can be no likelihood that it may permeate into the air passage, thus preventing an inconvenience such as a nozzle plugging from occurring. In particular, because the sliding surface associated with a chemical liquid is located at a lower elevation than the sliding surface for the air, an ingress of the chemical liquid into the air passage can be prevented in a positive manner.

While the cylinder unit assembled into the stationary valve member 28 (the cylinder unit 55 comprising the chemical liquid stator 34 having an annular space therein and the piston 50 secured to the sleeve member 32) is used in this embodiment by utilizing a construction in which the rotary valve member (rotary shaft) 16 is brought into abutment against the stationary valve member 28, the invention is not limited to the use of such a construction, but a cylinder arrangement as disclosed in Japanese Laid-Open Patent Application No. 1998-113630 or a spring arrangement as disclosed in Japanese Patent No. 3243967 may also be used. In addition, while the chemical liquid distributor 22 is separate from the rotary shaft 16 in the described embodiment, a common member may be used for both.

Figure 5:
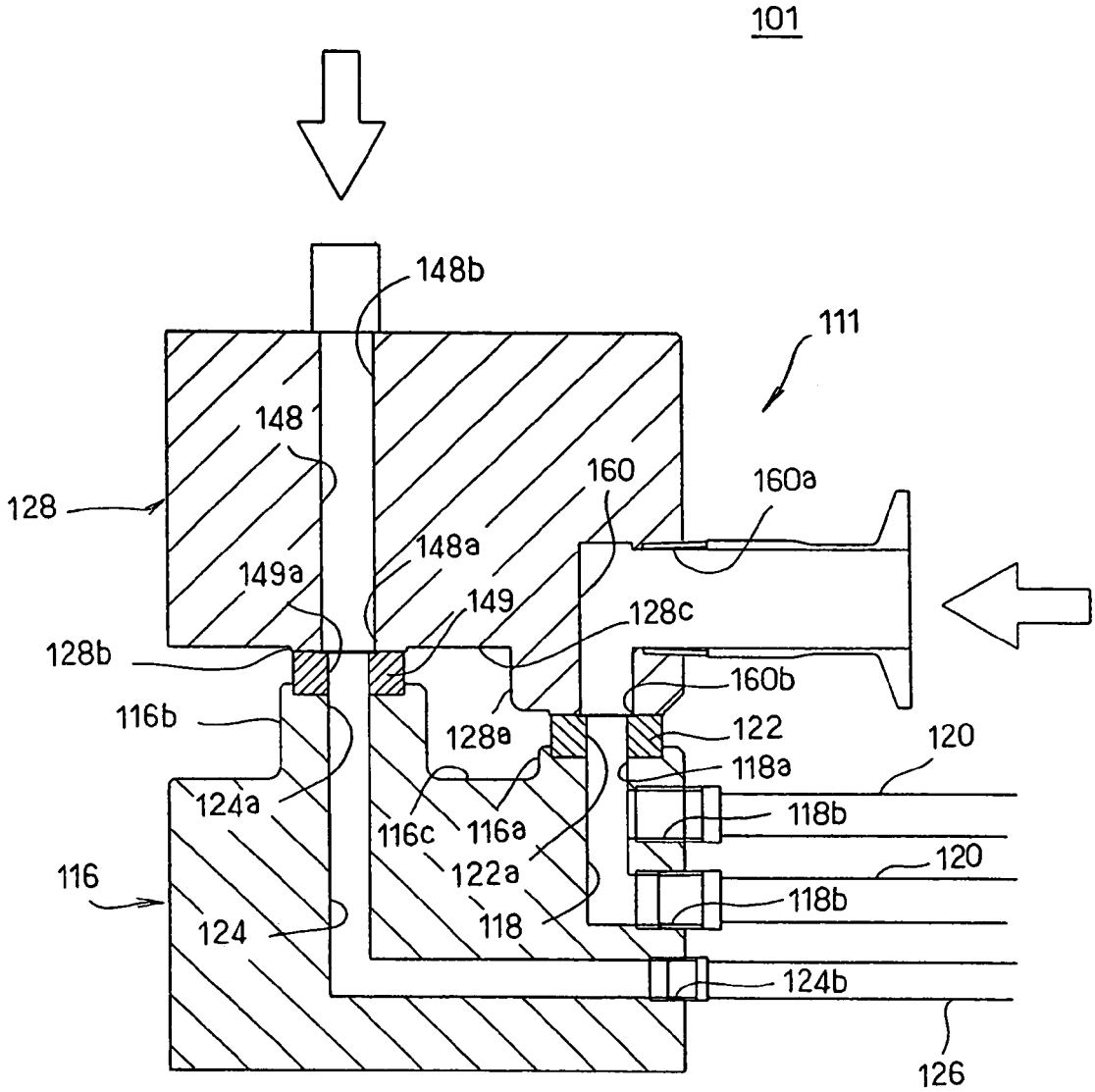
FIG. 5 is a longitudinal section a part of a rotary rinser according to a second embodiment.

Referring to FIG. 5, a second embodiment will be described. FIG. 5 is a view showing an essential part of a rotary valve 111 of a rotary rinser 101 according to a second embodiment. A rotary valve member 116 is formed with two annular projections 116*a* and 116*b* which are disposed at the end of the outer periphery and disposed toward the inner periphery. The both annular projections 116*a* and 116*b* have different heights, the annular projection 116*b* disposed toward the inner periphery being higher than the annular projection 116*a* disposed toward the outer periphery. An annular groove 116*c* is formed between the both annular projections 116*a* and 116*b*.

The rotary valve member 116 is formed with chemical liquid discharge passages 118 internally toward the outer periphery. The chemical liquid discharge passages 118 are disposed at an equal interval circumferentially as in the first embodiment, and each chemical liquid discharge passage 118 has an introduction port 118*a* which opens into the top surface of the annular projection 116*a* which is disposed toward the outer periphery, and a discharge port 118*b* which opens into the outer peripheral surface. An annular chemical liquid distributor 122 is connected to the upper surface of the annular projection 116*a* which is disposed toward the outer periphery. The chemical liquid distributor 122 is formed with communication holes 122*a* vertically extending therethrough, which are located at positions corresponding to the introduction ports 118*a* of the respective chemical liquid discharge passages 118.

On the other hand, a stationary valve member 128 which is disposed above the rotary valve member 116 is formed with annular projections 128*a* and 128*b* on its lower surface which are disposed toward the outer periphery and the inner periphery, respectively, with an annular groove 128*c* therebetween. The annular projection 128*a* which is disposed toward the outer periphery projects downwardly beyond the annular projection 128*b* which is disposed toward the inner periphery. A chemical liquid supply passage 160 is formed in the stationary valve member 128 toward the outer periphery, and has a supply port 160*a* which opens into the outer peripheral surface and an arcuate elongate opening 160*b* which opens into the lower surface of the annular projection 128*a* disposed toward the outer periphery.

The arcuate elongate opening 160*b* is disposed on a circumference of the same radius as the radius of the circumference on which the introduction ports 118*a* of the chemical liquid discharge passages 118*a* in the rotary valve member 116 and the communication holes 122*a* in the chemical liquid distributor 122 are disposed. As the rotary valve member 116 rotates, the chemical liquid discharge passage 118 which also rotates has its introduction port 118*a* connected to the arcuate elongate opening 160*b*, whereupon the chemical liquid supplied from the stationary valve member 128 is fed to a cleansing nozzle through the chemical liquid discharge passage 118 of the rotary valve member 116 and an associated chemical liquid piping 120.

The rotary valve member 116 is also internally formed with an air discharge passage 124. The air discharge passage 124 has an air introduction port 124*a* which opens into the upper surface of the annular projection 116*b* which is disposed toward the inner periphery, and an air distributor 149 which is connected to the upper surface of the annular projection 116*b* is formed with a communication opening 149*a* which is aligned with the air introduction port and which vertically extends therethrough. The air discharge passage 124 has a discharge port 124*b* which opens into the outer peripheral surface of the rotary valve member 116.

The stationary valve member 128 is formed with an air supply passage 148 which is disposed toward the annular projection 128*b* which is disposed toward the inner periphery. The air supply passage 148 has an inlet or supply port 148*b* which is connected to a source of air supply, not shown, so as to be supplied with the aseptic air. The outlet of the air supply passage 141 is formed by an arcuate elongate opening 148*a* extending across a given extent which is located on a circumference of the same radius as the radius of a circumference on which the communication holes 149*a* in the air distributor 149 are disposed, and when the introduction port 124*a* of the air discharge passage 124 and the communication hole 149*a* of the air distributor 149 are connected with the elongate opening 148*a* as they rotate, the aseptic air is fed through an air piping 126 into a cleansing nozzle.

The rotary valve 111 of this embodiment is arranged to maintain the stationary valve member 128 and the rotary valve member 116 in abutment against each other by abutment means, not shown, whereby the two annular projections 128*a* and 128*b* on the stationary valve member 128 and the two distributors 122 and 149 which are connected to the two annular projections 116*a* and 116*b* on the rotary valve member 116 simultaneously slide in close contact with each other.

In the present embodiment, the sliding surface into which the arcuate elongate opening 160*b* of the chemical liquid supply passage 160 formed in the stationary valve member 128 opens and the sliding surface of the chemical liquid distributor 122 which is connected to the rotary valve member 116 are disposed toward the outer periphery of the both valve members 116 and 128 while the sliding surface into which the arcuate elongate opening 148*a* of the air supply passage 148 opens and the sliding surface of the air distributor 149 are disposed toward the inner periphery, thus changing the radial positions of these both passages (the chemical liquid passage and the air passage) and also changing their elevations to eliminate the likelihood that a chemical liquid may be admixed into the air. By completely separating the radial positions and elevations, the admixture of the liquid into the air passage can be prevented if a highly osmotic liquid such as sodium hydroxide is used as a chemical liquid. Although one of fluids represents the aseptic air in this embodiment also, it should be understood that this fluid is not limited to the air, but may be replaced by a different gas such as a nitrogen gas or a carbonic acid gas.

The invention claimed is:

1. A rotary rinser comprising:

a stationary member in which a first supply passage and a second supply passage are formed;

a rotary member, located below the stationary member, rotatable about a central vertical axis and disposed to be slidable with respect to the stationary member, the rotary member comprising a first annular projection projecting upward at a first elevation and a second annular projection projecting upward at a second elevation together defining an annular groove between the stationary member and the rotary member to prevent a fluid admixture, and comprising a first discharge passage located within the first annular projection and a second discharge passage located within the second annular projection configured to move into and out of communication with the first and second supply passages, respectively, as the rotary member rotates, and are disposed such that during rotation of the rotary member, when the discharge passages are connected to the supply passages in the stationary member, a fluid is fed into a cleansing nozzle to be injected into a vessel;

wherein the supply passages and the discharge passages come into contact at respective sliding surfaces located at a junction of the stationary member and each one of the annular projections, the sliding surfaces being disposed at different relative elevations and at different radial positions relative to the central axis.

2. A rotary rinser according to claim 1 in which fluids are a cleansing liquid and a gas.

3. The rotary rinser of claim 1, wherein each discharge passage opens through one of the sliding surfaces.

4. A rotary rinser comprising:

a rotary member rotatably moveable about a central axis to a rinsing position, and defining a first fluid discharge passage and a second fluid discharge passage; and a stationary member in slidable engagement with the rotary member and defining a first fluid inlet and a second fluid inlet, the first fluid inlet being in fluid communication with the first fluid discharge passage when the rotary member is in the rinsing position and together defining a first flow junction, the second fluid inlet being in fluid communication with the second fluid discharge passage when the rotary member is in the rinsing position and together defining a second flow junction, the first flow junction disposed at an elevation different than the elevation of the second flow junction, and the first flow junction disposed at a radial position different than the radial position of the second flow junction relative to the central axis, such that an annular groove is formed between the first and second flow junction in order to prevent a fluid admixture.

5. The rotary rinser of claim 4, wherein the stationary member further comprises a chemical liquid stator which is moveable in a substantially vertical direction.

6. The rotary rinser of claim 4, further comprising a center shaft to which the rotary member is attached.

7. The rotary rinser of claim 4, wherein the rotary member further comprises a first annular projection adjacent the first flow junction and a second annular projection adjacent the second flow junction, together defining the annular groove therebetween.

8. The rotary rinser of claim 7, wherein the first annular projection and the second annular projection each define a discharge passage therein.

9. The rotary rinser of claim 8, wherein the first annular projection and the second annular projection define a first sliding surface and a second sliding surface, respectively, the first and second sliding surfaces being disposed immediately adjacent the stationary member.

10. The rotary rinser of claim 9, wherein the each discharge passage opens through a sliding surface.

11. The rotary rinser of claim 4, and further comprising a nozzle in fluid communication with the first fluid discharge passage and in fluid communication with the second fluid discharge passage.

* * * * *